United States Patent [19]

Miller

[11] 4,263,759

[45] Apr. 28, 1981

[54] SWIMMING POOL CONSTRUCTION AND METHOD OF MAKING THE SAME

[75] Inventor: Clarence J. Miller, Canton, Ohio

[73] Assignee: Bradley Enterprises, Inc., Canton, Ohio

[21] Appl. No.: 20,625

[22] Filed: Mar. 15, 1979

[51] Int. Cl.[3] ..... E04B 1/00; E04H 3/16

[52] U.S. Cl. ..... 52/169.7; 4/506; 52/309.8; 52/742; 264/31; 264/46.6

[58] Field of Search ..... 264/31, 46.6; 52/309.8, 52/169.7, 742; 4/172, 172.21, 488, 506, 513

[56] References Cited

U.S. PATENT DOCUMENTS

| | | | |
|---|---|---|---|
| 3,429,085 | 2/1969 | Stillman, Jr. | 52/309.8 X |
| 3,468,088 | 9/1969 | Miller | 52/250 |
| 3,841,041 | 10/1974 | Friedland et al. | 4/172 X |
| 4,027,442 | 6/1977 | Silverman | 52/169.7 |
| 4,032,608 | 6/1977 | Zinniger et al. | 264/46.6 |
| 4,142,337 | 3/1979 | Holcomb | 52/169.7 |

*Primary Examiner*—Alfred C. Perham
*Attorney, Agent, or Firm*—Frease & Bishop

[57] ABSTRACT

An in-ground swimming pool which utilizes a relatively flexible, continuous sheet-like wall member in combination with a bottom construction which is formed from polyurethane foam. The polyurethane foam bottom is reinforced at the surfaces of concave curvature with rail-like concrete members to which the foam is bonded.

Also disclosed is a method of forming the polyurethane bottom which consists of applying a relatively thin coating of polyurethane foam to the bottom excavation and immediately placing a sheet of polyethylene, 2 to 4 mils thick, over the foam before the foam has set, conforming and adhering the polyethylene sheet to the foam and earth surface. The final steps include applying a series of polyurethane foam layers by spraying over the polyethylene sheet to achieve a desired thickness. By following the procedures disclosed, the foam surface can be controlled to obtain the desired pool bottom smoothness.

11 Claims, 11 Drawing Figures

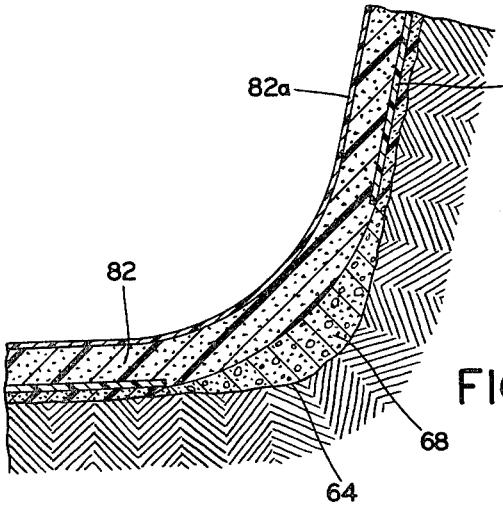
FIG. 7
FIG. 8
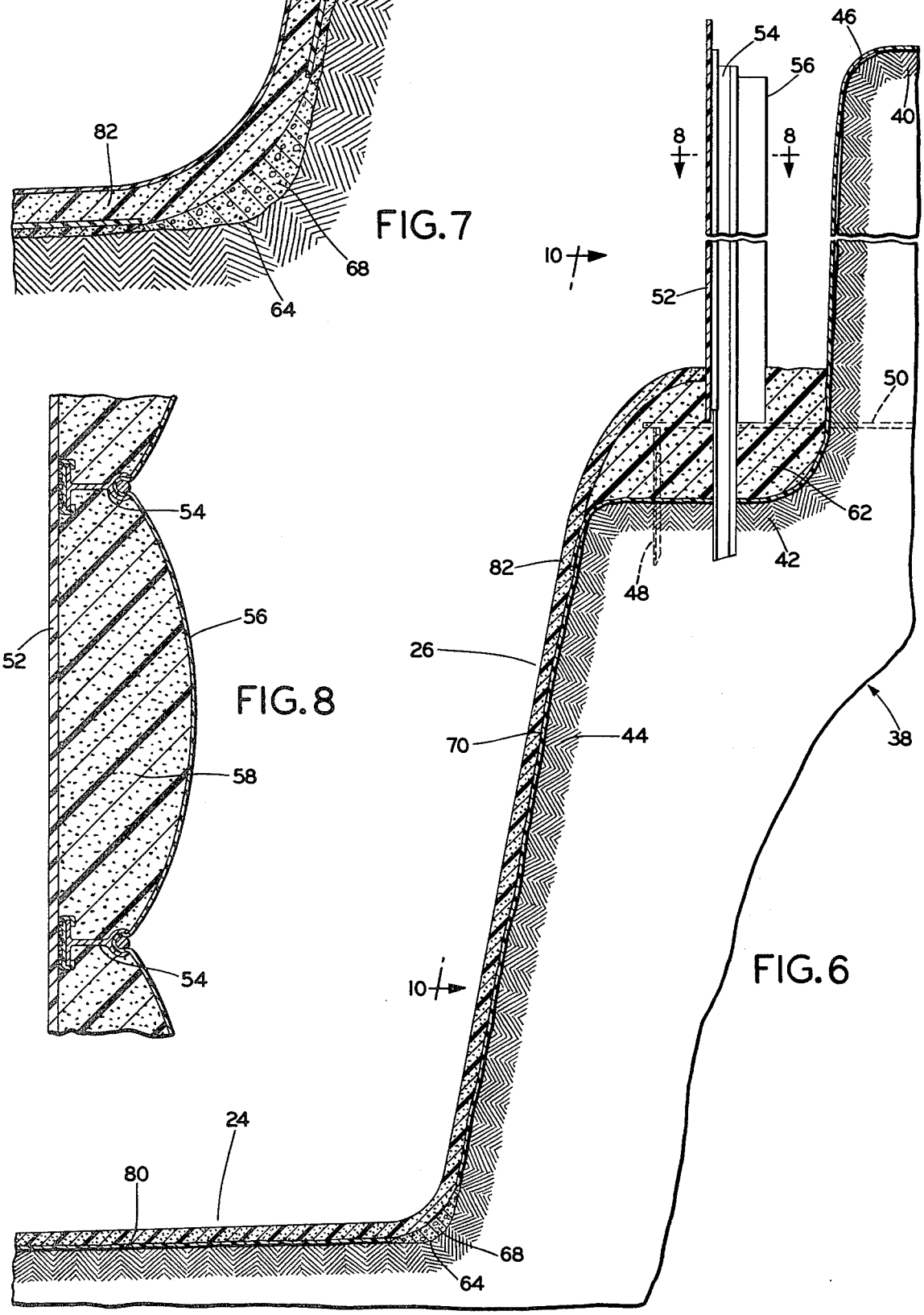
FIG. 6

SWIMMING POOL CONSTRUCTION AND METHOD OF MAKING THE SAME

FIELD OF THE INVENTION

This invention relates to swimming pool constructions and to the method of making the same. More particularly the invention relates to the structure of and a method of manufacturing in-ground swimming pool bottoms from polyurethane foam, which is sprayed upon the surfaces of an excavation.

DESCRIPTION OF THE PRIOR ART

There are many types of swimming pools manufactured and available today upon the commercial market. Such pool constructions include those manufactured from concrete or tile or concrete block, which are relatively expensive to manufacture because of the labor involved and the cost of raw materials, the so-called vinyl-liner type pool of which many styles and constructions are commercially available and a combination concrete-fiber glass construction shown in my U.S. Pat. No. 3,468,088 issued Sept. 23, 1969.

It has been proposed that a swimming pool construction can be manufactured by spraying polyurethane foam upon the surfaces of an excavation which has been formed into the configuration of the swimming pool. Such a proposed construction is described in Stillman, U.S. Pat. No. 3,429,085. The swimming pool construction described in this patent is totally unsatisfactory from a commercial standpoint for several reasons.

First, the required smoothness of the surfaces of the commercially acceptable swimming pool cannot be achieved by following the procedures described in the prior art. By spraying the foam directly upon the earth excavation, a mottled surface results which is unacceptable. Also the surface in contact with the earth will be porous which could lead to water absorption. Further, the necessary wall strength capable of withstanding below ground pressures cannot be achieved by following the procedures and methods outlined in the prior art.

The construction illustrated in my U.S. Pat. No. 3,468,088 is an entirely satisfactory swimming pool construction from the commercial standpoint both in terms of appearance of the finished pool as well as strength of the finished structure. However, because of the rising of labor and material costs in recent years and the relatively large amount of concrete necessary to manufacture the construction shown in the referred to patent, swimming pools have become relatively expensive to manufacture.

Further, it is becoming more difficult to obtain the services of competent and willing craftsmen to work with concrete. The most difficult problem is to coordinate the schedules of the few competent craftsmen with those of the pool builder and unpredictable weather.

A pool manufactured entirely from polyurethane foam would be relatively inexpensive as compared to a concrete pool, but no suitable or satisfactory pool construction utilizing sprayed polyurethane foam has, to my knowledge, been manufactured prior to my invention.

Accordingly, it is the object of the present invention to provide a swimming pool construction in which sprayed polyurethane foam can be incorporated into a swimming pool construction which will result in a swimming pool that has the required strength to resist the various pressures to which an in-ground swimming pool is subject, which can be manufactured with a surface appearance that has a commercially acceptable degree of smoothness, which can be manufactured at a cost that is substantially less than an equivalent concrete pool and which solves problems and satisfies deficiencies existing in the art and obtains new results in a simple and economical manner.

These and other objectives are obtained by the methods, steps, procedures, parts, constructions, combinations and subcombinations which comprise the present invention, the preferred embodiments of which are set forth and illustrated in the accompanying drawings and which are particularly pointed out and set forth in the appended claims.

SUMMARY OF THE INVENTION

One concept of the present invention involves the method of forming the bottom and portions of the side wall surfaces of a swimming pool by utilizing sprayed polyurethane foam to form the bottom and side wall surfaces. Sprayed polyurethane foam is formed from a two component liquid system which is sprayed with commercially available equipment. When sprayed together the two components combine together chemically and expand to form the foam. According to the present invention, a thin layer of relatively dense polyurethane foam or other tacky substance is applied directly upon the surfaces of the excavation. Immediately and before the foam has set, a thin sheet of polyethylene is quickly placed upon the sprayed foam. While the foam is setting, the polyethylene sheet is conformed to the surface to provide a base for subsequent layers of polyurethane foam. After the initial layer of foam upon which the polyethylene sheet has been placed partially sets and begins to generate heat, additional layers of polyurethane foam are sprayed first upon the sheet and then upon previously sprayed layers of foam until the desired thickness or smoothness of foam has been achieved. I have discovered that by placing the intermediate layer of polyethylene sheeting upon the initial layer of foam, that a very smooth surface can be achieved after spraying a series of layers of foam, one upon the other, even though the surface of the ground excavation may be relatively rough, damp or cold. If the ground excavation is very dry, it may be necessary to sprinkle the ground surface lightly with water to achieve the desired results.

The further aspect of the present invention involves the provision of reinforcing members or rails at those areas of the swimming pool bottom in which there is a relatively sharp angular transformation of the swimming pool surface; for example, at the area in which the swimming pool bottom meets the swimming pool side wall. The transition from side wall to bottom is relatively abrupt and may provide weak spots caused by the failure of the polyurethane foam to conform to the earth at this portion because of the fact that the polyurethane foam tends to shrink slightly, after initial expansion, upon setting. According to this aspect of my invention, I provide a reinforcing rail of concrete at the concave transition surface areas of the foam bottom prior to spraying the polyurethane foam. These rails provide a reinforcement for the sprayed foam in areas of the bottom where voids might otherwise occur that could result in rupture from the weight of water and consequent leaking.

By way of example, the improved swimming pool construction and the method of constructing the swimming pool are illustrated in the accompanying drawings forming a part hereof wherein similar numerals refer to similar parts throughout various figures and in which:

FIG. 6 is a fragmentary cross-section illustrating the pool bottom and side walls;

FIG. 7 is a fragmentary cross-section illustrating the transition from the pool side wall to the pool bottom;

FIG. 8 is a fragmentary cross-section taken on the lines 8—8 of FIG. 6;

DESCRIPTION OF THE PREFERRED EMBODIMENTS

Figure 1:
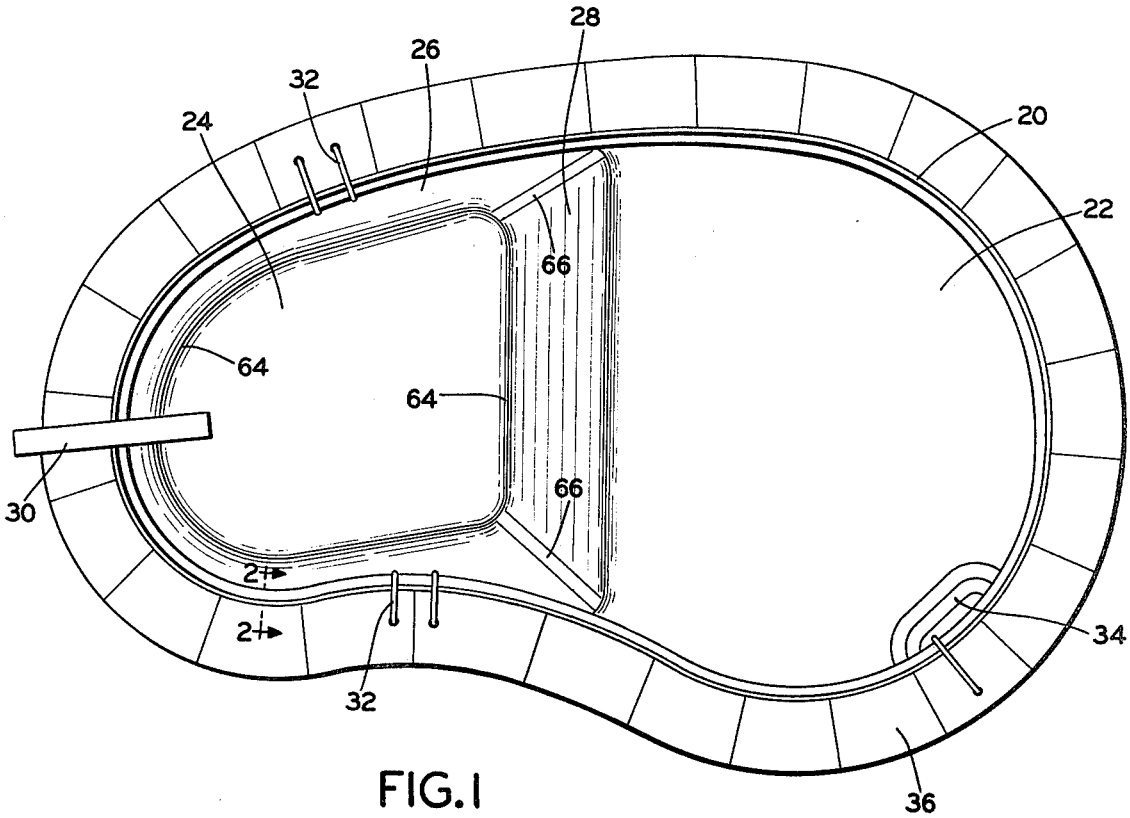
FIG. 1 is a top plan view of a typical swimming pool constructed in accordance with the principles of the present invention.

Referring to the drawings, a typical swimming pool manufactured in accordance with the principles of the present invention is illustrated in FIG. 1 and is illustrated in a general kidney-shaped outline. It is to be understood that the pool outline and dimensions can be of any desired shape and size. The pool includes side wall 20, shallow end bottom 22, deep end bottom 24, sloping side wall 26, and transition bottom 28 which connects the shallow bottom of the pool 22 with the deep bottom 24 and extends from one side of the pool to the other.

The swimming pool may be provided with a diving board 30, ladders 32, entry steps 34 and a deck 36. Any suitable or desired material such as concrete may be placed around the perimeter of the pool to form deck 36. Other accessories normally installed in a swimming pool, such as the pool plumbing, lights, water heaters, and the like are not illustrated, since they do not form a part of the present invention.

In general terms, the swimming pool is manufactured by making an excavation in the ground which has the general outline of the desired shape for the swimming pool. Next a vertical side wall formed of a continuous sheet member formed of fiberglas is set into place. Concrete reinforcing rails are then placed in those areas of the pool bottom where there is a concave transitional surface. Next, the remaining surfaces of the pool side walls and the pool bottom are formed by sprayed polyurethane foam in a manner to be described in detail below. After the foam has set or cured, suitable fill material is placed between the side wall and the excavation, the exposed surfaces of the polyurethane foam are painted and a deck installed around the perimeter of the pool.

Figure 2:
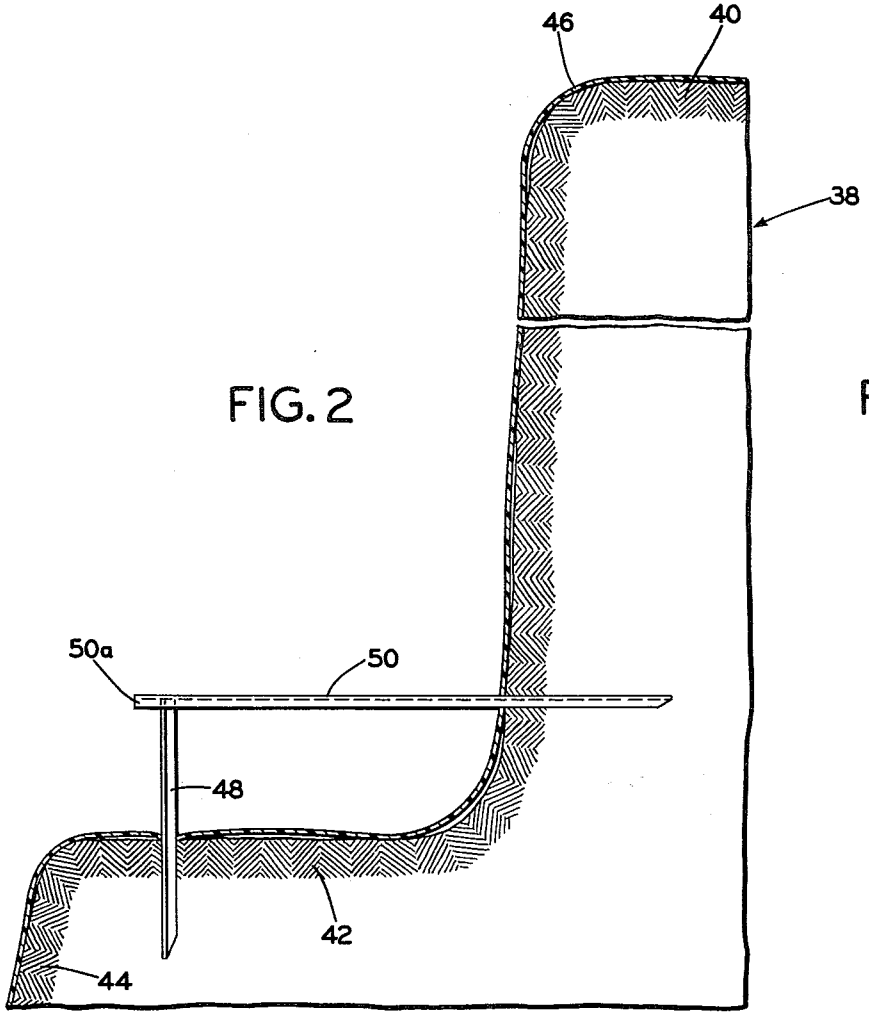
FIG. 2 is a cross-sectional view taken along line 2—2 of FIG. 1 through a portion of the swimming pool excavation illustrating the initial stages of construction.
Figure 5:
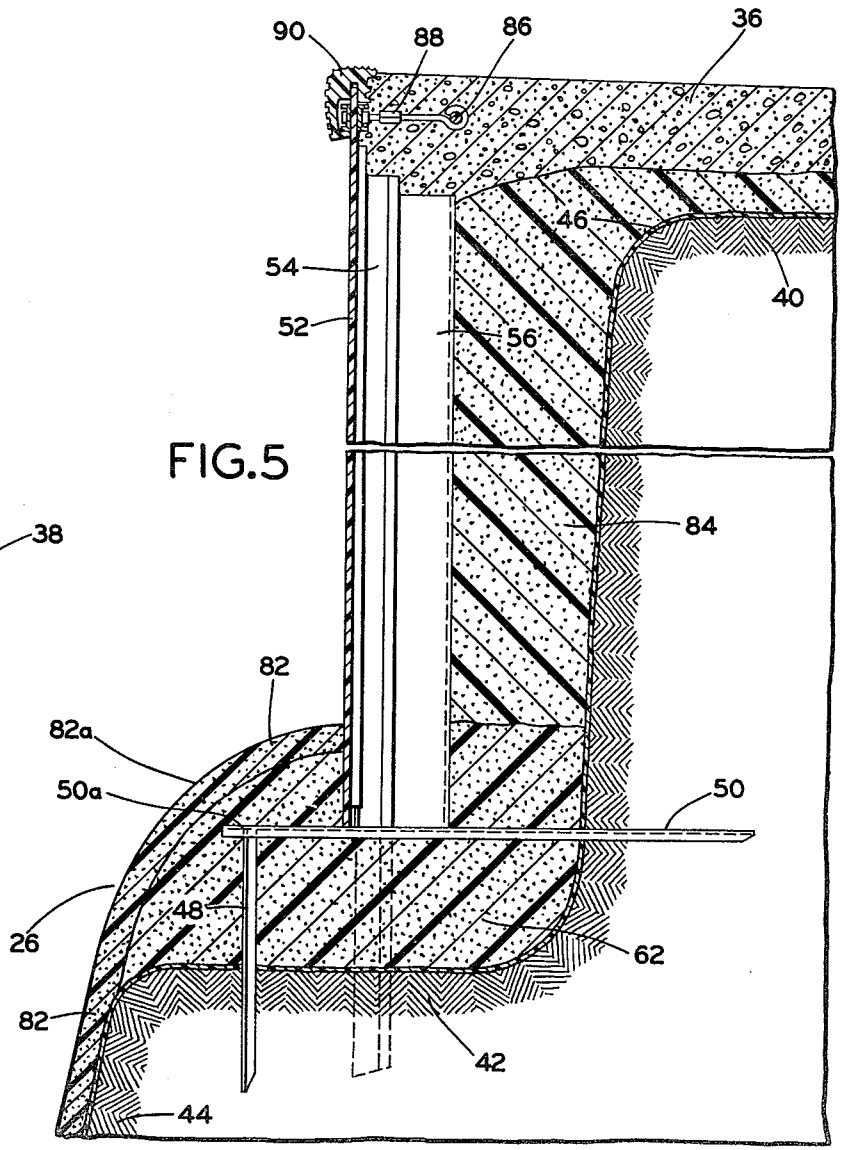
FIG. 5 is a cross-sectional view similar to FIG. 2 showing the completed swimming pool side wall.
Figure 4:
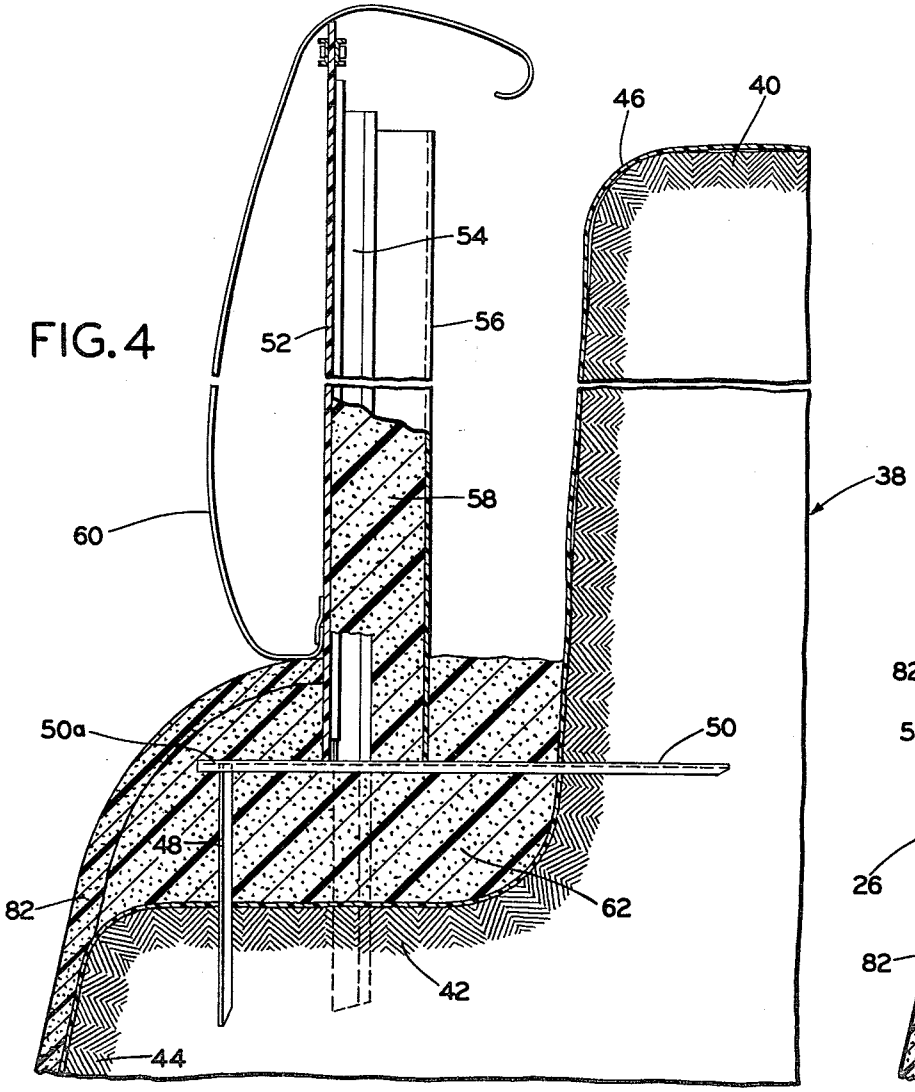
FIG. 4 is a cross-sectional view similar to FIG. 2 showing further steps in the procedures of the present invention.
Figure 10:
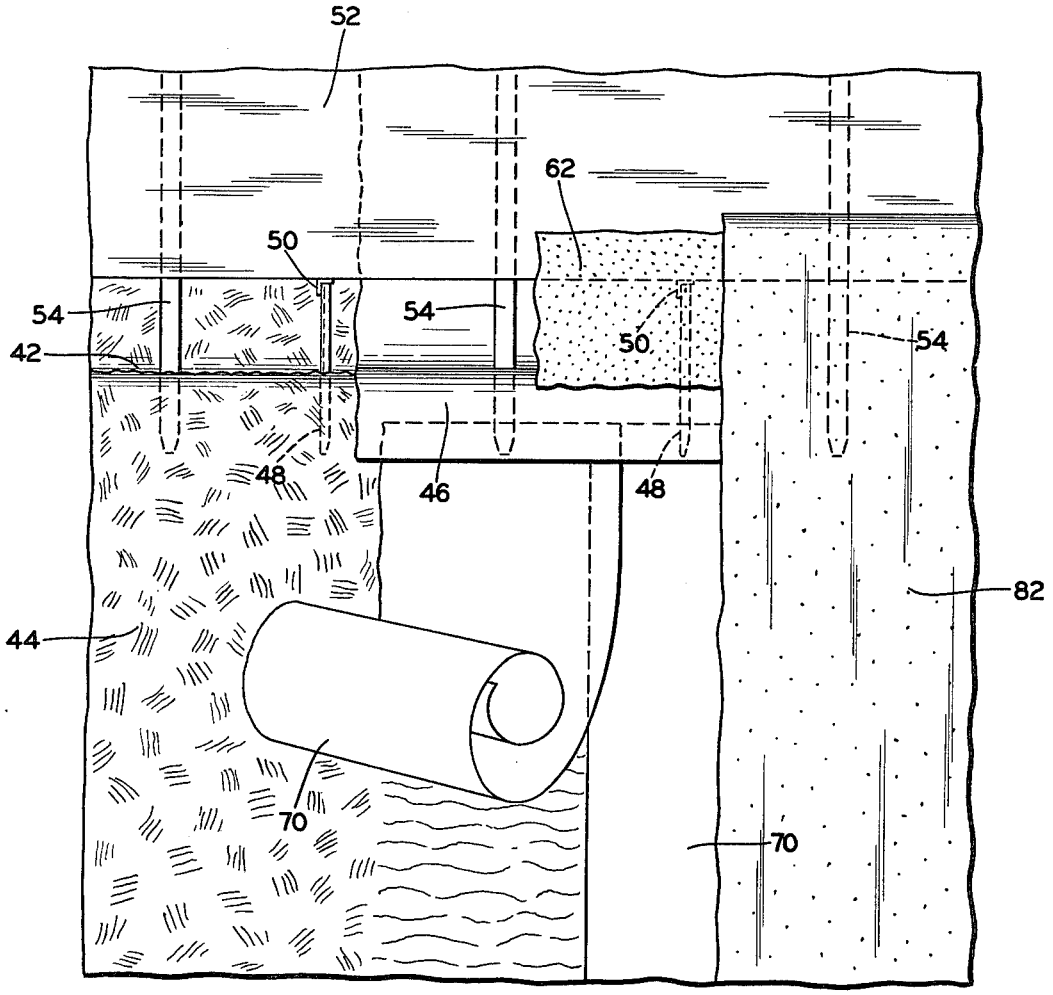
FIG. 10 is a side elevation, viewing in the direction of the lines 10—10 of FIG. 6, illustrating the method by which the sloping side walls of the swimming pool are constructed.

In FIGS. 2–5, the method of installing the swimming pool side walls and bottom, and the swimming pool structure is illustrated. In FIG. 2, the upper portion of the excavation is illustrated with the ground indicated generally at 38, which includes an upper portion 40, a footing area 42 and a lower side wall area 44 which is a part of sloping side wall 26.

In accordance with the procedures of the present invention, a sheet of relatively thin (2–4 mil thickness) polyethylene 46 is draped over the upper portion of the surface of the excavation to provide a non-porous surface in this area. Next supporting members are placed around the perimeter of footing area 42 and include vertical support 48 and a horizontal support 50. Support members 48 and 50 are placed around the entire footing area 42 at suitable intervals and provide a base upon which the continuous side wall member rests during installation and to provide means of leveling the side wall.

For example, vertical support 48 is driven into the ground in the footing area 42 and horizontal support 50 is then driven into the upper side wall area of the excavation with its outer end **50*a* supported by vertical support 48. After installation of a series of support members 48 and 50, a continuous wall member 52 is placed on the horizontal support 50 and arranged to the configuration of the upper portion of the finished side wall of the swimming pool. The inside surface of continuous wall member 52 is provided with a series of flexible form retaining members 54. Flexible form member 56, which together with the inside surfaces of side wall 52 provide a series of pockets for receiving side wall reinforcing means 58. The procedure for installing side wall 52, form retaining means 54, form 56 and the side wall reinforcing means 58** is described in my U.S. Pat. No. 3,468,088. In this patent, the preferred material used for reinforcing the side wall, the material placed in the pocket, is concrete, and concrete can be used to reinforce the side wall. However, in the present invention the preferred material to be utilized as the side wall pocket material is polyurethane foam as will be described in greater detail below.

Figure 3:
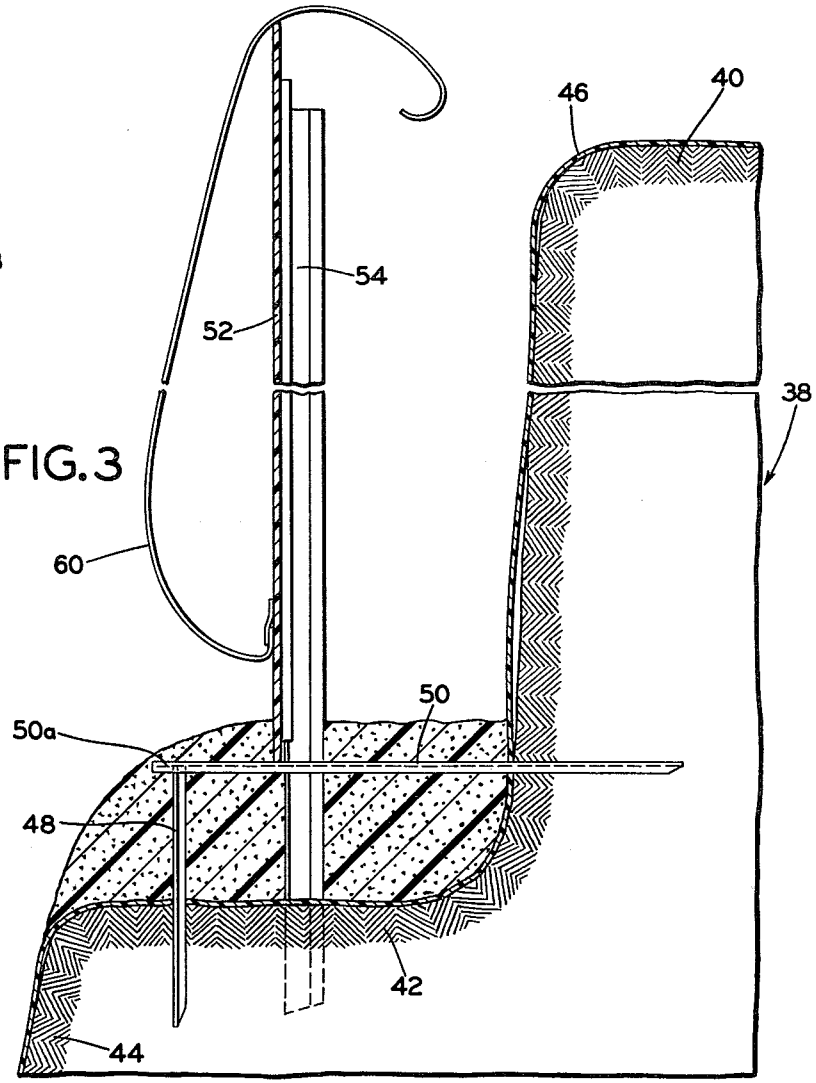
FIG. 3 is a cross-sectional view similar to FIG. 2 illustrating additional steps of the procedures of the present invention.

Referring to FIG. 3, after side wall 52 with retaining means 54 have been set and leveled, if necessary by adjustment of vertical support 48 and horizontal support 50, a sheet of polyethylene film 60 is temporarily attached to the lower end of side wall 52 and draped over the top of side wall 52 as a protection to the surface of side wall 52 during foam spraying operations.

The footing area 42 of the excavation is then filled with a suitable amount of low density polyurethane foam by spraying the foam into the footing area 42 until the approximate final footing 62 configuration is achieved, as shown in FIG. 3. The foam completely surrounds the supports 48 and 50 and the lower edge of side wall member 52 and form retaining means 54. The lightweight polyurethane foam utilized may be any suitable low density foam. However, I prefer to use polyurethane foam which has a 2 lb. per cubic foot density. An example of the preferred foam is that manufactured by the Witco Chemical Corporation. The foam is manufactured by spraying two components together in a 1:1 ratio by volume of Witco's ISOFOAM SS-24-44-A and ISOFOAM SS-24-44-B.

After the low density foam footing 62 has been formed in footing area 42, the exposed surface can be trimmed to a smooth surface with a knife or other suitable cutting instrument. This will provide a smooth base upon which the higher density foam will later be applied to form a safety walk around the perimeter of the pool at the bottom of side wall 52.

According to one aspect of the present invention, concrete rails are placed in all of the concave portions of the excavation. Referring to FIG. 1, these concrete rails will be placed around the perimeter of the pool bottom 24, indicated by reference numeral 64, and at the concave transitional portion 66, located at each side of the pool where the transitional side wall 28 extends from one side of the pool to the other. The structure is illustrated in FIG. 7 in cross-section in which the concrete rail is indicated at 68 and serves to reinforce the foam that will later be applied in this area.

Following the formation of the footing area 42, the pockets formed by side wall 52, retaining means 54 and form 56 are filled with side wall reinforcing means 58. The material used to fill the pockets, according to the present invention, is the same low density or lightweight polyurethane foam that is used to fill the footing area 42. Each of the pockets which are spaced around the outside perimeter of the pool are filled in similar fashion. The final configuration of the side wall after filling the pockets with low density polyurethane foam is shown in cross section in FIG. 8. It should be understood that both footing 62 and pocket material 58 can be formed of concrete if desired.

After the footing area 42 has been trimmed to achieve the approximate final configuration, a series of sheets of polyethylene film 70 are placed around the entire ground area of sloping side wall 26. They may be temporarily attached to the sloping side wall in any suitable manner and extend from the bottom of footing 62 to the concrete rail 68 located at the convex area where the sloping side wall 26 and pool bottom 24 meet. The sheets of polyethylene 70 are preferably of 2–4 mil thickness and can be of any desired width that is practical to work with under the circumstances. For example, a sheet of film approximately five feet wide may be placed and cut to the correct length to cover the area from the bottom of footing 42 to concrete rail 68 and may be attached by tacking the top edge of sheet 70 to the surface of the excavation with nails or some other suitable temporary fasteners.

After temporarily attaching polyethylene sheet 70, a thin layer of polyurethane foam is sprayed directly onto the excavation between polyethylene sheet 70 and the surface of the excavation. This is accomplished by raising the sheet 70 away from the excavation and spraying a layer of polyurethane foam directly upon the surface of the excavation. After the polyurethane foam has been sprayed upon the surface of the excavation, but prior to the foam's setting, the sheet of polyethylene film 70 is immediately pressed against the surface of the excavation and onto the uncured polyurethane foam.

During the setting of the polyurethane foam, heat will be generated since the foam setting is a thermochemical reaction. Also, the foam, while setting, acts as an adhesive and the polyethylene sheet 70 will adhere to the surface of the excavation. During the time that the foam is setting, the sheet 70 of polyethylene film is smoothed and conformed to the surface of the excavation and any small pockets of trapped air are eliminated.

According to this aspect of the invention, the polyurethane foam is of higher density than that used to form the footing 62. While any suitable higher density film can be used, I prefer to use polyurethane foam which has 20 lbs. per cubic foot density. An example of the preferred foam is manufactured by the Witco Chemical Corporation and constitutes a two-component system which is sprayed together in a 1:1 ratio by volume of Witco's ISOFOAM SS-0089A and ISOFOAM SS-0090W.

After the initial layer of foam sprayed upon the surface of the excavation and the sheet of polyethylene film 70 adhered thereto, a series of further layers of high density foam are sprayed first on the sheet 70 and then one upon the other until the desired wall thickness is achieved. In practice it has been found that between eight and fifteen individual layers, each approximately 1/64th to 1/16th of an inch thick, will provide an extremely satisfactory and strong side wall.

Figure 9:
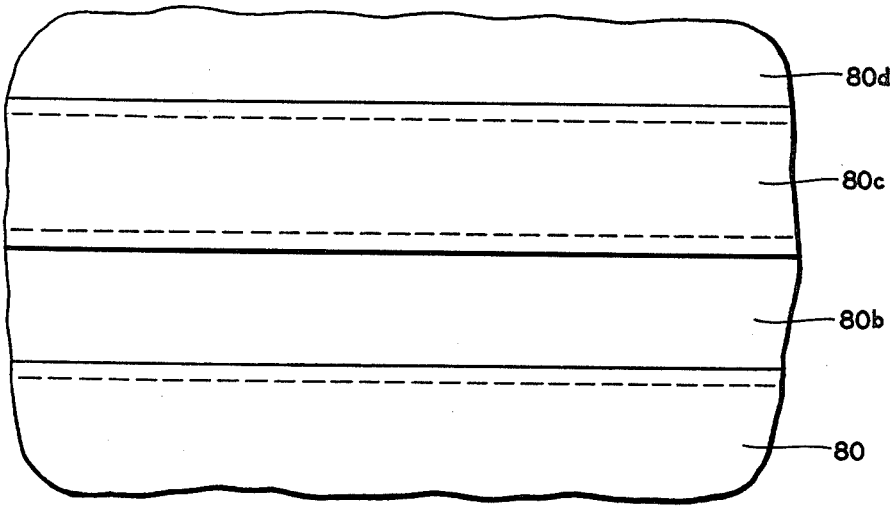
FIG. 9 is a fragmentary plan view of the swimming pool bottom illustrating one of the steps of the method of constructing the bottom of the pool.

A similar procedure is followed to form the bottom surface of the pool in both the shallow area 22 and the deep area 24. This procedure is, in part, illustrated in FIG. 9 in which an area of the bottom 24 is first sprayed with a thin layer of polyurethane foam. A sheet of polyethylene film 80, similar to that described above, is then placed upon the sprayed area during the time that the polyurethane foam is setting. The sheeting 80 is conformed and smoothed to the surface of the excavation and is adhered to the excavation surface by the adhesive nature of the foam during setting. Additional sheets of polyethylene film 80*b, c* and *d* are applied to the entire exposed surface area in a similar fashion, that is, by first applying a thin layer of polyurethane foam directly to the surface of the excavation and immediately placing the suitable size sheets of polyethylene film to the sprayed area until the entire surface area is covered with polyethylene film.

After the entire surface has been covered with polyethylene film, a series of thin layers of polyurethane foam are sprayed first on the film 80 and then one upon the other onto the entire pool bottom area until the desired thickness is obtained. Any suitable number of layers may be applied to the bottom, as with the sloping side wall; however, in practice it has been found that from eight to fifteen individual thin layers of foam 1/64th to 1/16th of an inch thick provide an extremely satisfactory and strong bottom.

In the foregoing description of the formation of the sloping side walls 26 and pool bottom 22 and 24, the polyethylene sheets 70 and 80 have been described as being placed over the entire surface of the pool wall 26 and bottom 22 and 24 and on the initial layer of foam. It is important, however, that the first layer of foam that is sprayed upon the polyethylene sheet be applied prior to the time in which the initial foam layer reaches its final set. It therefore may be necessary to spray the foam on the polyethylene sheeting in small areas of one sheet or several sheets. The procedure is then continued area by area until the entire excavation surface is completed.

The entire pool bottom is formed in the manner described and the multiple sprayed layers of foam are applied to all areas of the pool bottom including the low density foam footing 62, and the concrete rails 68.

Figure 11:
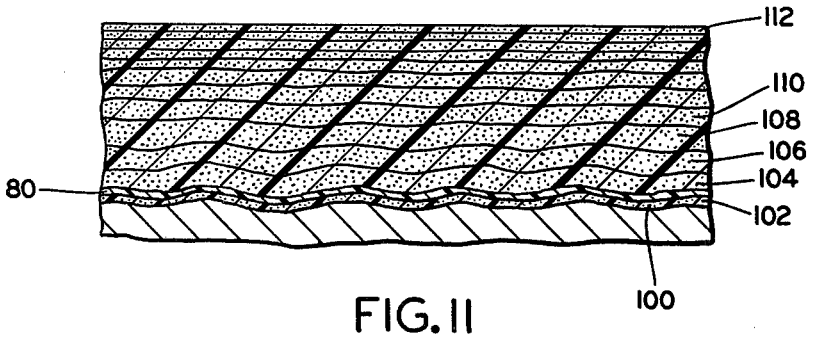
FIG. 11 is a cross-section through the bottom of the pool showing the manner in which multiple layers of foam are placed upon one another to achieve a smooth pool bottom surface.

The multiple sprayed layers of polyurethane foam each bond to one another to provide an integral bottom or wall, and in the drawings are illustrated as a single layer by reference number 82, except in FIG. 11.

After the multiple layers of foam have been sprayed over the entire pool bottom and sloping side walls, the entire surface of the foam is painted as indicated by reference numeral 82*a*, to provide a protective layer for the foam from the ultraviolet rays of the sun. The space between reinforced wall portion 52 and the upper portion of excavation 40 is then backfilled with any suitable material or it may be filled with the lightweight polyurethane foam as at 84 in FIG. 5. A reinforcing bar 86 may be attached to the upper edge of side wall 52 by an eye-bolt 88 and a suitable coping material 90 may be placed around the perimeter of the pool at the top edge of side wall 52. Finally, a concrete or other suitable deck 36 is placed surrounding the pool and can be formed of any desired material, concrete being indicated, however, bricks, flagstone or even lightweight foam or any other desired decking material may be used.

In this condition the pool is finished and ready for filling with water after removing the protective sheets of polyethylene film 60 which were temporarily installed to protect the surface of side wall 52 during the spraying of polyurethane foam.

An important aspect of the invention is illustrated in FIG. 11 which is an enlarged cross section of the bottom of the pool. The surface 100 of the excavation is, of course, prepared to be as smooth as possible under the circumstances. However, this surface is naturally somewhat irregular and rough. If the polyurethane foam were sprayed directly upon surface 100 of the excavation the foam, upon setting, would assume or exaggerate the irregular surface of the excavation 100. In accordance with the present invention, the initial layer 102 of foam is sprayed on the surface of excavation 100 and the sheet of polyethylene film 80 is immediately placed on the layer 102 of polyurethane foam after spraying, but before the foam has set. The sheet 80 of polyethylene film is adhered to the surface 100 of the excavation by the initial layer 102 of sprayed polyurethane during setting. The polyethylene film is smoothed and conformed as much as possible to the surface of the excavation 100, for example, by hand, to provide an essentially non-porous layer upon which the succeeding layers of foam will be sprayed. As shown in enlarged fashion in FIG. 11, the first layer 104 of polyurethane foam is sprayed directly upon the exposed surface of polyethylene film 80 and before layer 102 has fully cured. After the first layer 104 sets, succeeding layers 106, 108, 110 are sprayed one upon the other, until the final layer 112 is placed and the desired wall thickness is achieved. As illustrated in FIG. 11, as each succeeding layer is sprayed upon its predecessor, the surface of the foam is controlled during the spraying operation and tends to smooth out so that after approximately eight to ten layers of foam have been sprayed, the surface is essentially flat irrespective of the irregularity of the initial surface of the excavation 100. The smooth flat surface of final layer 112 is achieved because of the use of the film of polyethylene 80 which provides a smooth base. As each succeeding layer of foam is sprayed on top of one another, a puddling effect occurs and less foam is deposited in the higher spots and more foam is deposited during spraying in the lower spots in the irregularities.

Another important aspect of the present invention is the use of the concrete rails and concave portions of the excavation. During the spraying of the multiple layers of foam throughout the pool bottom, the foam is sprayed onto the concrete rails, and when setting, bonds to these rails. Because of the fact that foam has a tendency to first expand and then shrink slightly during the setting of the foam, the foam would have the tendency to pull away from the ground if it were sprayed directly upon the concave surface of the earth provided by the excavation. However, because the foam bonds to the concrete rails in these concave areas and because of the weight of the concrete rails, the foam does not shrink from the concave areas of the excavation in areas subject to great water pressure and a potential weak spot in the pool bottom is satisfactorily reinforced.

The resulting swimming pool construction built in accordance with the foregoing procedures, provides a swimming pool which can be installed with great simplicity and with commercially available equipment and materials. The bottom construction, formed of polyurethane foam, is functionally as strong as concrete and with a surface that is easier to maintain than concrete. Further, by using polyurethane foam, the high cost of concrete and the high cost of availability of satisfactory labor is avoided.

Finally, the threat of inclement weather is not an extremely important factor because the foam can be sprayed and set in a very short period of time.

If, for example, rain should occur during the formation of a pool bottom made from concrete, the rain could destroy the finished surface of the concrete, or destroy the strength of the finished concrete or require that work be stopped. However, foam sets in such a short period of time that rain won't mar the finish of the foam nor cause a weakness in the structure, or foam spraying operations can be interrupted and restarted when good weather prevails.

In the foregoing description the manufacture and construction of a swimming pool has been described. It should be understood, however, that the principles of the present invention can be employed to construct structures other than swimming pools. For example, the basement of a residential house could be finished by using the methods of the present invention and any other structure could be constructed where the final foam surface is to be smooth and non-porous.

In the foregoing description, certain terms have been used for brevity, clearness and understanding but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved swimming pool construction and method of making the same is constructed, assembled and operated, the characteristics of the new construction, and the advantageous, new and useful results obtained; the new and useful structures, devices, elements, arrangements, parts, and combinations are set forth in the appended claims.

I claim:

1. The method of constructing a polyurethane foam surface structure including the steps of: forming a base surface; applying a first layer of polyurethane foam upon said base surface; applying a film of polyethylene sheeting to said first layer of foam; conforming and adhering the polyethylene sheeting to said first layer of foam while said first layer of foam is curing; applying a second layer of polyurethane foam upon the polyethylene sheeting; and applying a plurality of layers of polyurethane foam upon said second layer of foam.

2. The method set forth in claim 1 in which the step of applying a second layer of polyurethane foam is carried out while the first layer of foam is curing.

3. The method set forth in claim 1 in which the step of applying a plurality of layers includes applying from eight to fifteen layers.

4. The method set forth in claim 3 in which the step of applying a plurality of layers includes applying each of said layers in a thickness of from 1/64 to 1/16 of an inch.

5. The method of constructing a swimming pool bottom including the steps of: forming an excavation in the ground to provide a bottom surface; applying a first layer of polyurethane foam upon said bottom surface; applying a film of polyethylene sheeting having a thickness in the range of two to four mils; to said first layer of foam while said first layer of foam is curing; applying a second layer of polyurethane foam upon the polyethylene sheeting while said first layer of foam is curing; and applying from eight to fifteen additional layers of polyurethane foam, each having a range of thickness between 1/64 of an inch to 1/16 of an inch, upon said second layer of foam.

6. Swimming pool side wall and bottom construction including an inground excavation forming bottom and side wall surfaces, a first layer of polyurethane foam sprayed upon the bottom and side wall surfaces, a sheet of polyethylene film placed upon the first layer of foam, a second layer of foam sprayed upon the sheet of polyethylene film, and a plurality of layers of polyurethane foam sprayed upon the second layer of foam.

7. Swimming pool construction as set forth in claim 6 in which the polyethylene film has a thickness of between two to four mils.

8. Swimming pool construction as set forth in claim 6 in which a plurality of layers includes from eight to fifteen layers of foam.

9. Swimming pool construction as set forth in claim 8 in which the second layer of foam and the plurality of layers of foam each have a thickness of from 1/64 of an inch to 1/16 of an inch.

10. Swimming pool construction as set forth in claim 6 in which said side walls and bottom meet in a concave transitional surface, and in which a rail of concrete is located at the concave surface between the foam and the excavation surface.

11. Swimming pool construction of the type in which an excavation is provided in the ground to provide the general pool outline including a bottom wall and side walls, said side and bottom walls converging in areas of concave curvature; in which a plurality of layers of polyurethane foam is applied to the bottom and side walls of the excavation, wherein the improvement includes a rail of concrete in the areas of concave curvature between the excavation and said foam, said foam being bonded to the concrete rail.

* * * * *